United States Patent [19]

Sudo et al.

[11] 4,314,862

[45] Feb. 9, 1982

[54] DUAL PHASE HIGH STRENGTH COLD-ROLLED STEEL PLATE

[75] Inventors: Masatoshi Sudo; Masanori Higashi, both of Kobe; Tsuguaki Ohki, Hyogo; Shoji Kanbe, Kobe, all of Japan

[73] Assignee: Kobe Steel, Ltd., Kobe, Japan

[21] Appl. No.: 183,711

[22] Filed: Sep. 3, 1980

[30] Foreign Application Priority Data

Oct. 16, 1979 [JP] Japan ..... 54-133689

[51] Int. Cl.[3] ..... C22C 38/38; C22C 38/32

[52] U.S. Cl. ..... 148/12 F; 75/126 B; 75/126 K; 75/126 P

[58] Field of Search ..... 75/126 B, 126 K, 128 P; 148/36, 12 F

[56] References Cited

U.S. PATENT DOCUMENTS

| | | | |
|---|---|---|---|
| 3,830,669 | 8/1974 | Matsuoka et al. | 148/12 F |
| 3,920,051 | 11/1975 | Bell et al. | 75/128 P |
| 4,062,700 | 12/1977 | Hayami et al. | 148/134 X |
| 4,072,543 | 2/1978 | Coldren et al. | 148/12 F |
| 4,196,025 | 4/1980 | Davies | 148/36 |

FOREIGN PATENT DOCUMENTS

| | | | |
|---|---|---|---|
| 49-42568 | 11/1974 | Japan | 75/126 B |
| 52-61122 | 5/1977 | Japan | 148/12 F |
| 55-31123 | 3/1980 | Japan | 148/12 F |
| 296827 | 3/1971 | U.S.S.R. | 75/126 B |
| 434128 | 12/1974 | U.S.S.R. | 75/128 P |
| 668970 | 6/1979 | U.S.S.R. | 75/126 K |

*Primary Examiner*—Peter K. Skiff

*Attorney, Agent, or Firm*—Oblon, Fisher, Spivak, McClelland & Maier

[57] ABSTRACT

A dual phase high strength cold-rolled steel plate, comprising 0.02–0.15 weight % carbon, 1.5–2.5 weight % Mn, less than 0.2 weight % Si, 0.2–1.5 weight % Cr, 0.03–0.15 weight % P, less than 0.06 weight % Al, less than 0.02 weight % S, and the balance iron and unavoidable impurities. The steel according to the present invention permits the low-temperature transformation products to be formed in a greater proportion within a short annealing time to lower the yield ratio and zeroizes the yield point elongation without skin pass rolling. Moreover, the composition is completely free from adverse effects on tensile strength, ductility and galvanizing properties and can provide cold-rolled steel plate suitable for a wide use including motor vehicles.

8 Claims, 3 Drawing Figures

ANNEALING TEMPERATURE:

- ■ 700°C
- □ 725°C
- ● 750°C
- ○ 775°C
- ▲ 800°C
- △ 825°C

ANNEALING TEMPERATURE:

- ■ 700°C
- □ 725°C
- ● 750°C
- ○ 775°C
- ▲ 800°C
- △ 825°C

DUAL PHASE HIGH STRENGTH COLD-ROLLED STEEL PLATE

BACKGROUND OF THE INVENTION

1. Field of the Invention

The present invention relates to a dual phase high strength cold-rolled steel plate, and more particularly to a cold-rolled steel plate which shows excellent formability in press-forming or other shaping operations and has a sufficient strength after a forming operation, along with a good galvanizing property.

2. Description of the Prior Art

For filling the recent strong demand for reductions of body weights of motor vehicles, there has been a tendency of using sheets of high tension steel of smaller thicknesses. The steel sheets are also required to be satisfactory in formability and other properties when worked in a galvanized form. Steel sheets have a general tendency in their properties that their yield points are elevated with increases in tensile strength. That is to say, a higher strength is reflected by lower forming characteristics, giving rise to various problems such as spring-back, galling during press-forming operations. In this regard, there are many reports on the results of attempts which have thus far been made in various aspects to lower the yield point of high strength steel, for example, a composite structure (or dual phase) steel sheet which is produced by continuous annealing technology has a low yield ratio and is free of elongation at yield point, receiving wide attention and consideration as a sheet steel for motor vehicles.

In order to obtain the composite structure (normally consisting of a ferrite phase surrounded by uniformly dispersed low-temperature transformation products such as martensite and bainite), it is generally required to retain a soaking period longer than one minute unlike the nomenclature "continuous annealing". It is not known to form a composite structure during annealing of a shorter time period. The annealing time in an ordinary continuous molten zinc galvanizing line, however, is 20 to 30 seconds at longest. It is therefore very practical if the formation of the composite structure is completed within such a short time period, but the present inventors do not known nor are aware of any report which give discussions on this point.

SUMMARY OF THE INVENTION

With the foregoing in view, the present invention has as its object the provision of a high strength cold-rolled steel plate which is produced by utilizing an ordinary continuous molten galvanizing line as an annealing line for forming a composite structure as mentioned above, and which can simultaneously satisfy the requirements of low yield ratio, high strength and zero elongation at yield point.

For attaining the above-mentioned object, the present inventors carried out improvement of the kinds of the alloy component and the blending ratio. In this connection, an Si-Mn system is generally employed as a basic design of the alloy components in the conventionally known composite structure cold-rolled high strength steel plates. As mentioned hereinbefore, the Si-Mn system needs retention of a soaking period longer than one minute after quick heating. As a result of extensive studies for an alloy composition which can replace the above-mentioned conventional system, it has been found that the retention time period can be reduced and the composite structure can be formed even in a simple thermal cycle involving no reheating treatment after annealing, by employing an Mn-Cr system as basic components and adding thereto more than 1.5% Mn (wt % and the same applies hereafter) and more than 0.2% of Cr, and that the resistance to corrosion is enhanced by including Si in a proportion of or less than 0.2% to form low Si steel without imposing adverse effects on the properties of the composite structure steel plate, low yield ratio and zero elongation at yield point, including studies on other alloy components.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like or corresponding parts through the several views and wherein.

DETAILED DESCRIPTION OF THE PREFERRED EMBODIMENTS

Figure 1:
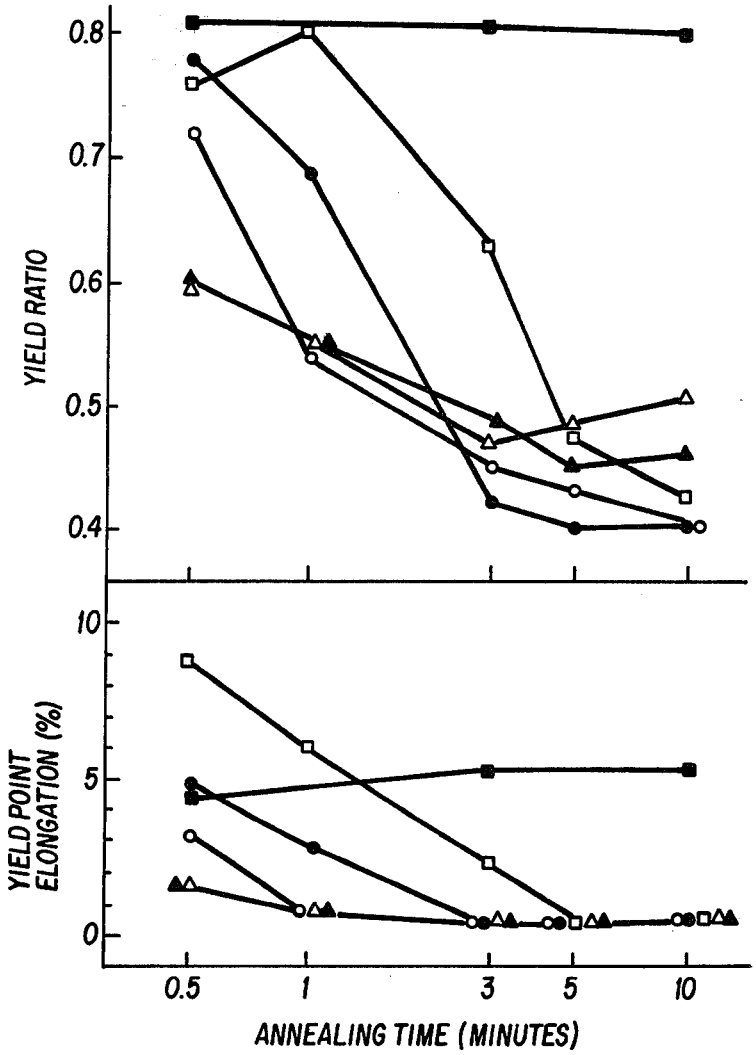
FIG. 1 is a graph showing the influences of the annealing time and temperature on the yield ratio and yield point elongation.

The alloy components in the composite structure (dual phase) structure high strength cold-rolled steel plate of the present invention include 0.02–0.15% of C, 1.5–2.5% of Mn, less than 0.2% of Si, 0.2–1.5% of Cr, 0.03–0.15% of P, less than 0.06% of Al and less than 0.02% of S. This composition is not exclusive and may include other alloy components if desired. For example, in addition to the above-mentioned essential elements, the composition may further include 0.006–0.02% of N and at least either 0.003–0.1% of Nb or 0.05–0.2% of V. Another example of the alloy composition includes, besides the essential elements of C, Mn, Si, Cr, P, Al and S in the above-defined ranges, 0.0005–0.01% of B and at least one member selected from the group consisting of 0.003–0.1% of Nb, 0.01–0.1% of Ti and 0.01–0.1% of Zr.

The above-mentioned limitations of the components and the respective ranges are based on the following reasons.

Firstly, the element C which improves the hardening property is one of essential elements for ensuring a high strength of the cold-rolled plate, and, in order to attain this effect, needs to be blended in an amount greater than at least 0.02%. The upper limit should be 0.15% since a C-content in excess of 0.15% would deteriorate the ductility and lower the weldability due to formation of pearlite.

Nextly, the element Mn aids to impart a high strength to the steel plate by accelerating the hardening property and, solely for this purpose, suffices to be included in at least 0.8%. However, as shown hereinlater by the results of experiments, it should be blended in an amount greater than 1.5% for reducing the annealing time for the formation of the composite structure to a time length comparable to that of immersion in the zinc bath.

However, the upper limit should be 2.5% since a Mn-content in excess of 2.5% would lower the ductility due to increased hardening and give rise to formation of a laminar structure in a distinctive degree due to segregation of Mn.

Cr which contributes to improve the hardening and mechanical properties is an essential element and, as shown hereinlater by the results of experiments, its content needs to be at least 0.2% in order to reduce the annealing time necessary for the formation of the composite structure and to obtain a low yield ratio, preferably more than 0.4%. However, an excessive Cr-content gives an adverse effect on cold workability so that it should be blended in an amount less than the upper limit of 1.5%, preferably less than 1%. The element Cr also contributes to the stabilization of ferrite, and is considered to accelerate the concentration of carbon of $\alpha$-phase into $\gamma$-phase, lowering the second phase transformation temperature to facilitate the formation of the composite structure in a short annealing time.

Similarly to Cr, the element P acts to release carbon in $\alpha$-phase to $\gamma$-phase. This effect is manifested when P is contained more than 0.03%, forming a ferrite phase free of carbides. With a greater P-content, carbon is released more easily within a short annealing time. However, a P-content in excess of 0.15% has a possibility of intergranular embrittlement so that the upper limit should be placed at 0.15%. The preferred range is 0.03–0.1%.

Si has been considered to be an essential element in the conventional composite structure high strength cold-rolled steel plates. However, the research by the present inventors revealed that it is not necessarily an essential element and is rather preferred to be contained as small an amount as possible since its existence makes it difficult to remove scales from hot-rolled strip and deteriorates the surface conditions of the cold-rolled steel plate. Therefore, its upper limit was placed at 0.2%.

Al is a deoxidizing element and added for adjusting the crystal grains. An Al-content of 0.06% contributes to finely divide the structure and gives good results in the strength and other properties of the steel.

Lastly, the element S can be a cause of production of sulfides which considerably deteriorate cold-forming and bending properties so that its content is preferred to be as small as possible and less than 0.02%.

The steel plate which contains the above-mentioned essential alloy elements has advantages that a low yield ratio is achieved and no elongation occurs at the yield point, irrespective of the hot- and cold-rolling conditions and even if the soaking time period in the subsequent quick heating is shortened to less than one minute.

Further, according to the present invention, the alloy composition may include the following optional components in addition to the essential elements of the above-defined ranges, depending upon the purpose for which the steel plate is intended to serve or upon special properties which are required of the steel plate.

The optional component N which enhances the A.A property (accelerated aging property) of the steel plate has a lower limit of 0.006% and an upper limit of 0.02% since a content in excess of 0.02% would impair the press-forming property of the plate.

The components Nb and V are elements suitable for increasing the strength of the cold-rolled steel plate and serve for strengthening precipitation and at the same time for improving the hardening property. The lower limits of Nb and V for producing these effects are 0.003% and 0.05%, respectively. However, excessive contents of these elements increase the strength too much and thus invite a deterioration in ductility. Therefore, the upper limits of Nb and V should be 0.1% and 0.2%, respectively. If desired, the composition may include either Nb or V alone.

The optional components Ti and Zr and blended for further increasing the strength of the steel plate. In a Mn-steel as in the present invention, they are expected to have the effect of increasing the strength in place of Mn. Ti and Zr which has as a main action the precipitation strengthening effect serve to control the form of sulfides and fix N, while securing in a maximum degree the ferrite-transformation suppressing effect by B as will be described hereinlater. The lower limits for ensuring Ti and Zr to take these effects are 0.01%, respectively. However, a content in excess of 0.1% will result in an excessively high strength and deterioration in ductility, so that the upper range is delimited at 0.1%. Ti and Zr are optional elements, either one of which may be employed solely for obtaining the above-mentioned effects.

Lastly, B has the effect of suppressing transformation to ferrite under coexistence with Ti and/or Zr. More particularly, it prevents the $(\alpha+\gamma)$ phase from being transformed in its entire amount to ferrite at the time of transformation in the cooling stage, forming therearound martensite and bainite to facilitate the formation of the composite structure. The minimum content necessary for securing this effect is 0.0005%. On the other hand, the above-mentioned effect is saturated at 0.01% and the upper limit should be 0.01% since a B-content in excess of 0.01% has a possibility of imparting hot shortness.

While there have been described the roles of the respective alloy elements along with the reasons for each defined range, the description is supplemented by the following experimental data.

An alloy steel of 0.05% C–1.3% Mn–0.5% Cr was melted in a high frequency vacuum melter and hot-rolled to obtain a slab of 20 mm in thickness. The slab was heated to 1200° C. in an Ar gas atmosphere and hot-rolled down to a finish temperature of 900° C. and a thickness of 3.0 mm, followed by a soaking temperature of 650° C.×2 hours and air cooling for the precipitation of AlN and then by cold rolling to obtain a steel plate of 0.8 mm in thickness. The steel plate was quickly heated up to 700°–825° C. by the use of a salt bath and soaked for 0.5–10 minutes at that temperature, then cooling the plate at an average speed of 9.8°–11.1° C./sec down to 400° C. with air cooling thereafter to room temperature.

The annealing temperature and time of the above-described alloy steel are graphically illusted in FIG. 1 in relation with resulting mechanical properties, in which the yield ratio and the elongation at yield point are shown respectively in the upper and lower sections of the graph. As seen in FIG. 1, the elongation at yield point is reduced with a higher annealing temperature and a longer annealing time. In view of this tendency, the annealing temperature has to be raised in order to shorten the annealing time period without causing increases in the yield point elongation. However, it is observed that, with an annealing time less than 1 minute, the yield point elongation cannot be zeroized even if the annealing temperature is raised to 825° C. That is to say, it is difficult to zeroize the yield point elongation during a short annealing treatment comparable in time length to the molten zinc galvanizing treatment.

Figure 2:
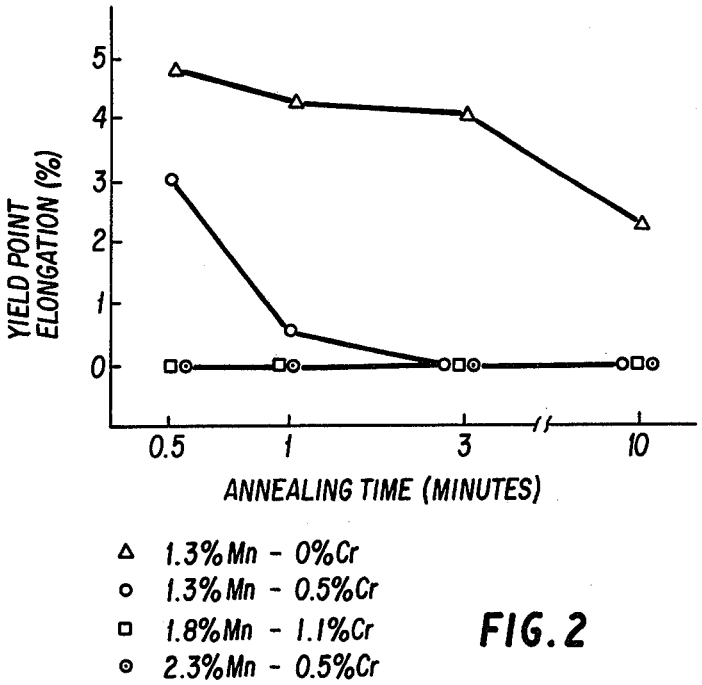
FIG. 2 is a graph showing the relation between the annealing time and the yield point elongation for different contents of the alloy components.

FIG. 2 graphically illustrates the influences of the Mn blending rate on the relation between the annealing time and yield point elongation in steel plates which were produced under the same conditions as in FIG. 1 except that the annealing time was fixed at 775° C. As seen in this figure, as long as the Mn content is 1.3%, it is impossible to zeroize the yield point elongation. However, when the Mn content is increased to 1.8% and 2.3%, the yield point elongation is zeroized irrespective of the variation in Cr content from 0.5 to 1.1%. The lower limit of Mn content for securing this effect was determined at 1.5% by further study in detail.

Figure 3:
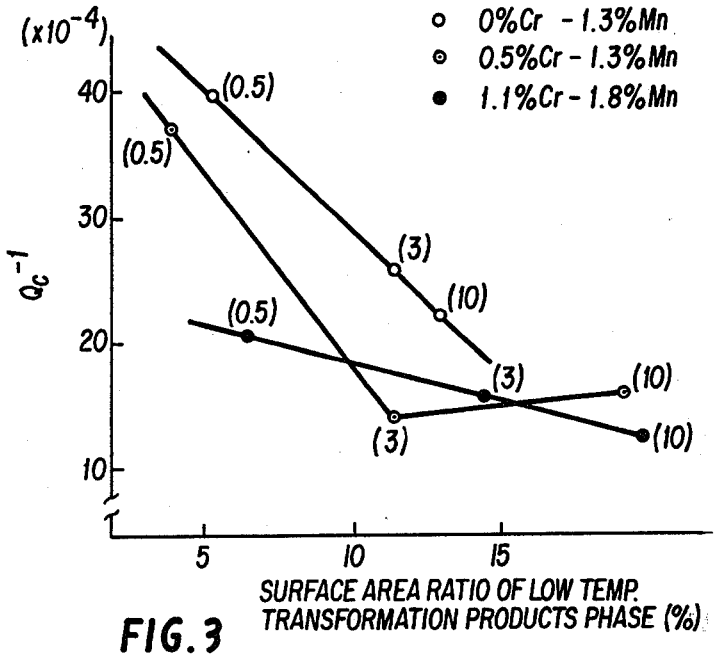
FIG. 3 is a graph showing the relation between the low-temperature transformation products phase and the internal friction energy.

As mentioned hereinbefore, Cr is an additive element which improves the annealing and mechanical properties and, when its content is less than 0.2%, it is difficult to zeroize the yield point elongation in a short annealing time even if the Mn content is within the above defined range. In addition, with a Cr content less than 0.2%, the yield ratio is increased considerably as seen in Comparative Examples 2, 4, 5 and 6 of Table 1, inviting degradations in workability. The steel plate of the present invention has zeroized elongation at yield point as shown in FIG. 2 and Table 1 but the most important and characteristic element in the steel of the present invention is Cr which is considered to act according to the following mechanism. Namely, in a steel which contains low-temperature transformation products such as martensite and bainite, it is assumed that the high initial mobile dislocation density (in ferrite) associated with martensite diminishes the yield point elongation. However, in a case where a substantial amount of Cr exists in the system, the condensation of carbon into austenite is thereby accelerated at the time of quick heating. As a result, $\gamma$ is established and transformation to ferrite in the cooling stage is suppressed, increasing the low-temperature transformation phase and mobile dislocation (density) in the ferrite phase. This assumption is supported by the data of FIG. 3 which shows the relation between the areal fraction (%) of the low-temperature transformation products phase and the internal friction peak ($Q_c^{-1}$). More particularly, as the annealing time (annealing temperature: 775° C.) becomes longer, the above-mentioned areal fraction is increased and the internal friction peak is lowered. Further, it is clear that, with a greater Cr content, the internal friction energy is small and the ferrite-stabilizing element Cr accelerates the condensation of C into $\gamma$ phase. The difference is particularly distinctive for short annealing time periods.

Table shows the mechanical and galvanizing properties of steel plates of different alloy compositions which were treated in the same manner as in FIG. 1. Examples A-I according to the present invention are low in yield ratio and zeroized in elongation at yield point without skin pass rolling. In contrast, Comparative Examples 1-6 have high yield ratios and undergo elongation at yield point, which elongation being zeroized only when skin pass rolling is provided.

It will be appreciated from the foregoing description that the composition according to the present invention permits the low-temperature transformation products to be formed in a greater proportion within a short annealing time to lower the yield ratio and zeroizes the yield point elongation without skin pass rolling. Moreover, the composition is completely free from adverse effects on tensile strength, ductility and galvanizing properties and can provide cold-rolled steel plates which are suitable for a wide use including motor vehicles.

TABLE 1

| Example | Chemical Composition (%) | | | | | | | | | | | |
|---|---|---|---|---|---|---|---|---|---|---|---|---|
| | C | Si | Mn | P | Cr | Al | N | S | Nb | V | B | Ti,Zr |
| A | 0.06 | 0.01 | 1.83 | 0.047 | 0.48 | 0.015 | 0.006 | 0.007 | — | — | — | — |
| B | 0.11 | 0.01 | 1.80 | 0.049 | 0.47 | 0.019 | 0.006 | 0.007 | — | — | — | — |
| C | 0.05 | 0.01 | 2.25 | 0.049 | 0.49 | 0.015 | 0.006 | 0.007 | — | — | — | — |
| D | 0.05 | 0.01 | 1.84 | 0.044 | 0.94 | 0.020 | 0.006 | 0.007 | — | — | — | — |
| E | 0.04 | 0.01 | 1.84 | 0.098 | 0.48 | 0.020 | 0.006 | 0.007 | — | — | — | — |
| F | 0.06 | 0.01 | 1.90 | 0.049 | 0.48 | 0.020 | 0.010 | 0.010 | 0.02 | 0.10 | — | — |
| G | 0.07 | 0.1 | 1.80 | 0.053 | 0.48 | 0.020 | 0.006 | 0.010 | — | — | 0.002 | Ti 0.06 |
| H | 0.06 | 0.1 | 1.90 | 0.049 | 0.51 | 0.018 | 0.006 | 0.006 | 0.03 | — | 0.001 | Ti 0.02 |
| I | 0.06 | 0.1 | 1.90 | 0.044 | 0.50 | 0.025 | 0.006 | 0.007 | 0.02 | — | 0.001 | Zr 0.07 |
| 1 | 0.019 | 0.02 | 1.24 | 0.045 | 0.47 | 0.011 | 0.006 | 0.007 | — | — | — | — |
| 2 | 0.06 | 0.01 | 1.30 | 0.045 | tr | 0.020 | 0.006 | 0.007 | — | — | — | — |
| 3 | 0.06 | 0.52 | 1.51 | tr | 1.01 | 0.004 | 0.006 | 0.007 | — | — | — | — |
| 4 | 0.11 | 0.50 | 1.48 | 0.005 | tr | 0.034 | 0.006 | 0.007 | — | 0.15 | — | — |
| 5 | 0.046 | 1.75 | 0.20 | tr | tr | 0.002 | 0.0042 | 0.007 | — | — | — | — |
| 6 | 0.053 | 1.98 | 0.99 | tr | tr | 0.024 | 0.0034 | 0.007 | — | — | — | — |

| Example | Yield Point $\sigma y$ (kg/mm$^2$) | Tensile strength (kg/mm$^2$) | Yield ratio 94 $y/\sigma B$ | Elongation El (%) | Strength Elongation B × El | Yield point elongation YPE (%) | Galvanizing property |
|---|---|---|---|---|---|---|---|
| A | 20.2 | 45.7 | 0.44 | 34.3 | 1590 | 0 | 0 |
| B | 21.1 | 50.8 | 0.42 | 29.6 | 1489 | 0 | 0 |
| C | 27.1 | 66.8 | 0.41 | 24.2 | 1614 | 0 | 0 |
| D | 19.8 | 48.5 | 0.41 | 35.0 | 1698 | 0 | 0 |
| E | 22.1 | 51.0 | 0.43 | 33.4 | 1735 | 0 | 0 |
| F | 37.7 | 69.9 | 0.54 | 24.5 | 1712 | 0 | 0 |
| G | 35.4 | 66.8 | 0.58 | 25.5 | 1703 | 0 | 0 |
| H | 40.8 | 74.3 | 0.55 | 24.6 | 1828 | 0 | 0 |
| I | 34.0 | 67.9 | 0.50 | 25.4 | 1725 | 0 | 0 |
| 1 | 19.6 | 37.4 | 0.53 | 37.4 | 1380 | 1.5 | 0 |
| 2 | 32.9 | 43.3 | 0.76 | 35.8 | 1550 | 3.8 | 0 |
| 3 | 38.7 | 73.8 | 0.54 | 19.8 | 1461 | 0* | X |
| 4 | 38.1 | 67.7 | 0.56 | 24.4 | 1866 | 0* | X |
| 5 | 45.5 | 62.3 | 0.73 | 23.5 | 1464 | 0* | X |

TABLE 1-continued

| | | | | | | | |
|---|---|---|---|---|---|---|---|
| 6 | 49.9 | 65.2 | 0.77 | 19.8 | 1291 | 0* | X |

Note 1: Examples A-I are of the present invention and 1-6 are Comparative Examples.
Note 2: The mark (*) in "YPE" indicates a value after skin pass (no mark no skin pass).
Note 3: Of the ratings in "Galvanizing Property", 0 = good and X = defective.

What is claimed as new and desired to be secured by Letters Patent of the United States is:

1. A dual phase high strength cold-rolled steel plate, characterized by the composition consisting essentially of 0.02–0.15% of C, 1.5–2.5% of Mn, less than 0.2% of Si, 0.2–1.5% of Cr, 0.044–0.15% of P, less than 0.06% of Al, less than 0.02% of S, and the balance of iron and unavoidable impurities, wherein said plate is annealable at 775° C. for less than one minute to give said dual phase and a yield point elongation of zero without skin pass rolling, a tensile strength of at least 45.7 kg/mm$^2$, and a yield ratio of no more than 0.58.

2. A dual phase high strength cold-rolled steel plate as set forth in claim 1, wherein said plate is galvanized with molten zinc.

3. A dual phase high strength cold-rolled steel plate, characterized by the composition consisting essentially of 0.02–0.15% of C, 1.5–2.5% of Mn, less than 0.2% of Si, 0.2–1.5% of Cr, 0.044–0.15% of P, less than 0.06% of Al, less than 0.02% of S, 0.006–0.02% of N, at least either 0.003–0.1% of Nb or 0.05–0.2% of V, and the balance of iron and unavoidable impurities, wherein said plate is annealable at 775° C. for less than one minute to give said dual phase and a yield point elongation of zero without skin pass rolling, a tensile strength of at least 45.7 kg/mm$^2$, and a yield ratio of no more than 0.58.

4. A dual phase high strength cold-rolled steel plate as set forth in claim 3, wherein said plate is galvanized with molten zinc.

5. A dual phase high strength cold-rolled steel plate, characterized by the composition consisting essentially of 0.02–0.15% of C, 1.5–2.5% of Mn, less than 0.2% of Si, 0.2–1.5% of Cr, 0.044–0.15% of P, less than 0.06% of Al, less than 0.02% of S, 0.0005–0.01% of B, at least one member selected from the group consisting of 0.003–0.1% of Nb, 0.01–0.1% of Ti and 0.01–0.1% of Zr, and the balance of iron and unavoidable impurities, wherein said plate is annealable at 775° C. for less than one minute to give said dual phase and a yield point elongation of zero without skin pass rolling, a tensile strength of at least 45.7 kg/mm$^2$, and a yield ratio of no more than 0.58.

6. A dual phase high strength cold-rolled steel plate as set forth in claim 5, wherein said plate is galvanized with molten zinc.

7. A method of manufacturing a dual phase high strength cold-rolled steel plate having zero yield point elongation without skin pass rolling, comprising the steps of:

making a steel consisting essentially of the composition as defined in claim 1, 3 or 5;

cold-rolling said steel to form said plate; and annealing said plate for less than one minute at 775° C. or higher.

8. The method of claim 7, wherein said annealing occurs on a continuous molten galvanizing line.

* * * * *